US006071187A

United States Patent [19]

Knutsson et al.

[11] Patent Number: 6,071,187

[45] Date of Patent: Jun. 6, 2000

[54] DEVICE AND METHOD FOR SEPARATING FOREIGN OBJECTS FROM A MASS OF COINS

[75] Inventors: Jörgen Knutsson, Lund; Staffan Lundgren, Malmö, both of Sweden

[73] Assignee: Scan Coin Industries AB, Malmo, Sweden

[21] Appl. No.: 08/913,495

[22] PCT Filed: Feb. 7, 1996

[86] PCT No.: PCT/SE96/00142

§ 371 Date: Dec. 12, 1997

§ 102(e) Date: Dec. 12, 1997

[87] PCT Pub. No.: WO96/30877

PCT Pub. Date: Oct. 3, 1996

[30] Foreign Application Priority Data

Mar. 28, 1995 [SE] Sweden ..... 9501091

[51] Int. Cl.[7] ..... G07D 3/00; B65H 3/62; B07B 1/24

[52] U.S. Cl. ..... 453/3; 221/203; 222/412; 209/286; 209/296

[58] Field of Search ..... 221/202, 203, 221/200; 453/3; 222/412, 56; 209/284, 285, 286, 288, 293, 296, 687

[56] References Cited

U.S. PATENT DOCUMENTS

| | | | |
|---|---|---|---|
| 2,398,955 | 4/1946 | O'Toole . | |
| 2,646,805 | 7/1953 | Anderson | 453/8 |
| 3,007,576 | 11/1961 | Hannaford | 209/288 |
| 3,196,887 | 7/1965 | White, Jr. | 453/8 |
| 3,292,818 | 12/1966 | Jaworski | 221/203 |
| 4,535,915 | 8/1985 | West | 222/56 |
| 5,122,094 | 6/1992 | Abe | 221/203 |
| 5,163,868 | 11/1992 | Adams et al. . | |
| 5,480,061 | 1/1996 | Ellinger | 221/203 |
| 5,564,546 | 10/1996 | Molbak et al. . | |
| 5,620,079 | 4/1997 | Molbak . | |

FOREIGN PATENT DOCUMENTS

| | | |
|---|---|---|
| 0 091 731 | 10/1983 | European Pat. Off. . |
| 62-50876 | 10/1987 | Japan . |
| 4-67776 | 6/1992 | Japan . |
| WO 97/33257 | 9/1997 | WIPO . |

*Primary Examiner*—Robert P. Olszewski
*Assistant Examiner*—Bryan Jaketic
*Attorney, Agent, or Firm*—Merchant & Gould P.C.

[57] ABSTRACT

A device is used to separate foreign objects from a mass of coins between a coin intake and a coin lifting device in a coin sorting and/or counting machine. The device has a perforated drum (13; 33), which is rotatable around its longitudinal axis, is open at its respective ends and is connected at a first end to the coin intake and at a second end to the coin lifting device. The machine also has a driving device (15, 16, 35) for rotating drum.

9 Claims, 3 Drawing Sheets

DEVICE AND METHOD FOR SEPARATING FOREIGN OBJECTS FROM A MASS OF COINS

TECHNICAL FILED

The present invention relates to a device and a method for separating foreign objects from a mass of coins between a coin intake and a coin lifting device in a coin sorting and/or counting machine.

DESCRIPTION OF THE PRIOR ART

Today, a plurality of devices are known for coin sorting and/or counting. Such devices or machines are usually provided with a coin intake and a coin lifting device (such as a hopper), wherein the coin intake is arranged to receive an incoming mass of coins and to supply this mass of coins to the coin lifting device, which establishes some sort of order among the coins in the mass, such as a sequential order, so that the coins one after another may be supplied at a proper speed to a subsequent sorting and/or counting process.

Recently, such coin sorting machines and coin counting machines, which are intended to be used directly by the customers in accordance with a self-service approach, have been increasingly common. Such self-service coin handling machines may be located in for instance bank offices to be used by any customer who wants to cash or deposit an unsorted mass of coins. For instance, a businessman may want to deposit his daily earnings, or a private person may bring his savings. The customer in question will deposit the mass of coins in a coin intake, and then the coin handling machine will sort and count the coins received and acknowledge the amount received by means of for instance a written verification, on which the counted amount is specified.

A problem with self-service coin handling machines of the type described above, which has been observed by the inventors of the present invention, is the damage or reduced performance that foreign objects in a mass of coins may cause. Previously known coin handling machines are usually provided with a separating function, wherein any coin not accepted due to e.g. an incorrect currency, deformation of the coin or the like, is separated from the rest of the coins and is returned to the customer, or is confiscated by the machine as an alternative. The problem gets worse if the coin mass contains such foreign objects, which as to their shape, size or the like are considerably different from coins acceptable to the machine. Examples of such foreign objects are paper clips, safety-pins, screws, nuts, hair pins, pocket fluff, etc. If such foreign objects are deposited in a coin handling machine, the risk of damage to mechanical or electrical components in the machine is not negligible.

Futhermore, if the mass of coins is deposited by the customer into the coin intake in such volumes or at such a speed that the coin handling machine will not be capable of processing the coin mass but will rather be over-filled, additional problems will arise.

SUMMARY OF THE INVENTION

According to the invention a device and a method have been developed to eliminate or reduce the above-mentioned problems, when a mass of coins with inappropriate contents or of an inappropriate volume is supplied by a customer to a coin handling machine.

The object of the invention is achieved by a device and a method for separating foreign objects from a mass of coins between a coin intake and a coin lifting device in a coin sorting and/or counting machine with the features of the characterising part of the appended independent patent claims.

BRIEF DESCRIPTION OF THE DRAWINGS

The invention will be described in more detail in the following, reference being made to the accompanying drawings, in which.

DETAILED DESCRIPTION OF THE INVENTION

Figure 1:
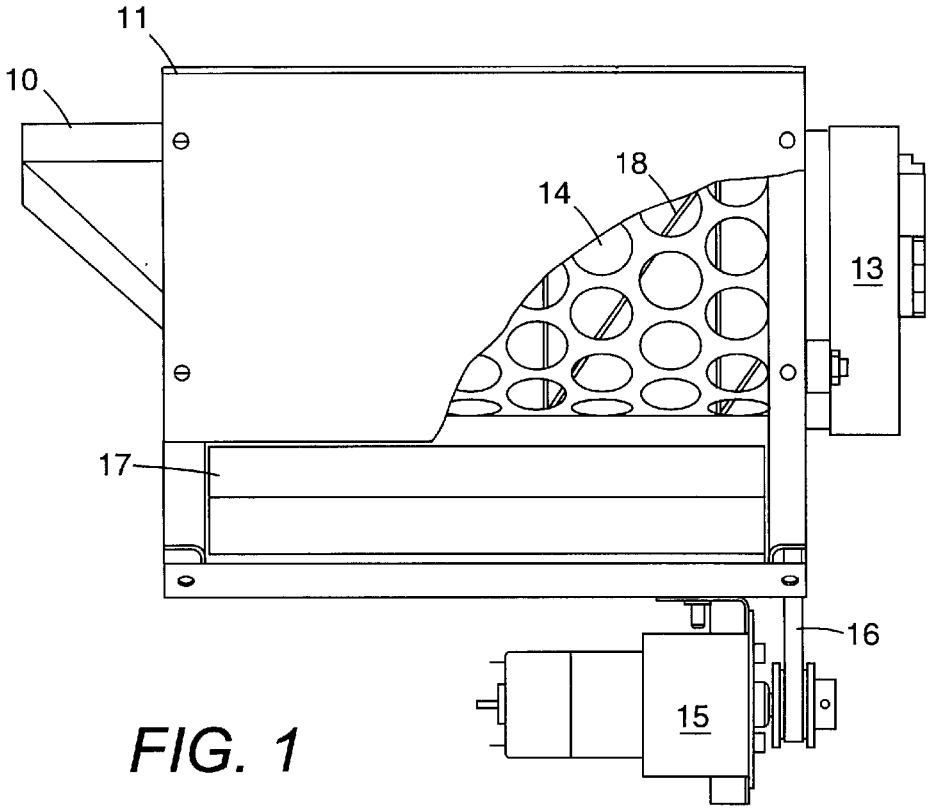
FIG. 1 is a partly fractioned side view of a device according to a preferred embodiment of the invention, FIG. 2 a partly exploded perspective view of the device according to FIG. 1, FIGS. 3 and 4 illustrate alternative embodiments of an insert element used in the device.

A preferred embodiment of the device according to the invention will now be described with reference to FIGS. 1–4.

The device comprises a coin intake 10, suspension means 11, 12, a drum 13 with perforations 14, a driving device 15 with a driving belt 16 belonging thereto, a collecting vessel 17, and a drum insert 18. The device is arranged to be mounted by means of the suspension means 11,12 between the coin intake and a coin lifting device in a coin sorting and/or counting machine. The drum 13 is open at its respective ends, is connected at its first end to the coin intake 10, which in turn is connected to the coin intake in the coin sorting and/or counting machine, and is connected at its second end to the coin lifting device in said machine. The drum 13, having a substantially circular cross section, is preferably made of e.g. metal or plastics and is according to the preferred embodiment horizontally arranged, but may as an alternative be arranged at a certain downward or upward inclination.

An insert element 18 is arranged inside the drum 13, as indicated in FIG. 1. In the exploded view according to FIG. 2 the insert element 18 is illustrated as being withdrawn from the drum 13, for reasons of clarity. Essentially, the insert element 18 has the shape of a so called Archimedes screw, which in essence may be described as a series of interconnected and substantially circular discs, each of said discs being cut along the main portion of its diameter with a minor portion of each circle diameter being left uncut in order to keep the two circle halves together.

Figure 2:
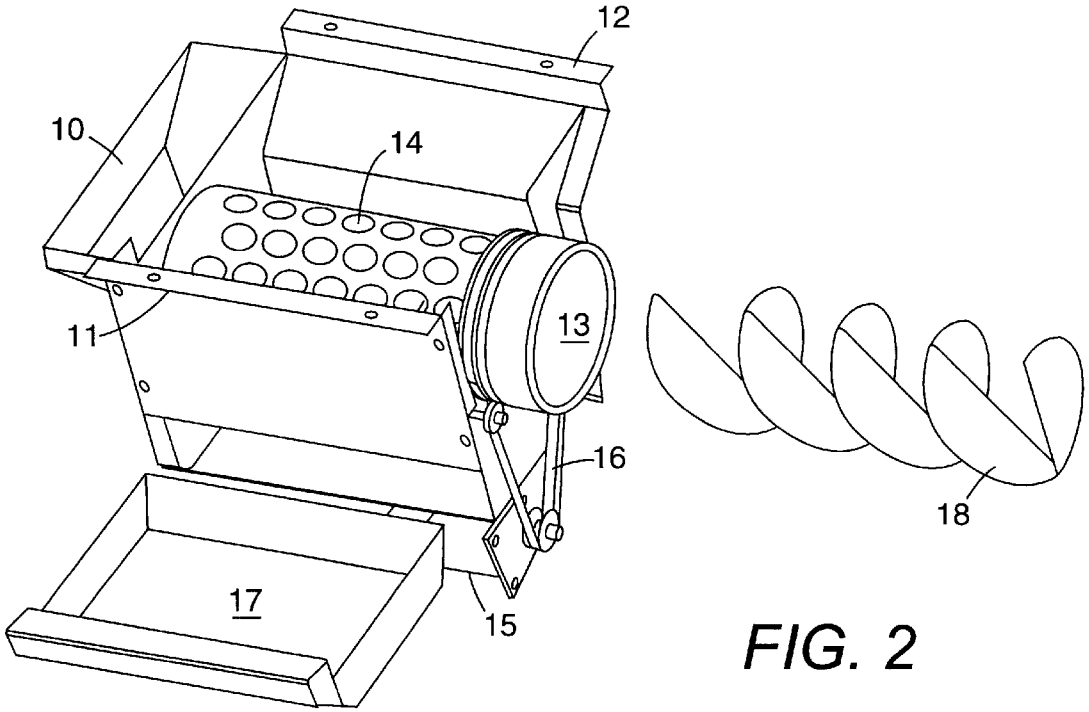

According to FIG. 2 one circle half of each circle is vertically arranged (i.e. arranged in the radial direction of the drum 13), while the second circle half is arranged at a certain angle with respect to the first circle half. Each vertical circle half is connected at its first end to the subsequent angled circle half and at its second end to the preceding angled circle half. The same is true for the angled circle halves with respect to the vertical ones, with the exception, of course, of the outermost circle halves at the respective ends of the insert element 18. Depending on the distance discussed below between two vertical circle halves the angled half has a substantially circular shape (a short distance), or an elliptic shape (a longer distance), respectively.

Preferably, the insert element 18 is manufactured of a relatively thin metal plate, and the insert element is firmly mounted on the inside of the drum 13 by for instance soldering or welding.

As a consequence of the arrangement described above a number of cells or segments are formed by the insert element 18, each segment consisting of two vertical circle halves and an intermediate angled half (or, equivalently, two angled halves and an intermediate vertical half). As a result, when the drum 13 is rotated, a mass of coins deposited through the coin intake 10 is transported through the drum 13 thanks to the helical movement being performed by the insert element 18. However, during half of the revolution of the drum 13 and the insert element 18 the mass of coins is tumbled "on the spot" (i.e., substantially without movement in the transport direction), since one of the circle halves is vertically arranged, thereby blocking the mass of coins. This fact has the important effect of giving foreign objects—particularly elongated objects—an increased opportunity to arrange themselves in a direction suitable for separation through the perforations 14 of the drum 13, i.e. a radial direction with respect to the drum, and this effect will be described in more detail below.

The number of segments is important for several reasons. The more segments dividing an insert element of a certain length, the better the separation becomes of foreign objects, since these objects are exposed to more tumblings and are hence given a better opportunity to be separated. On the other hand, the transport velocity in the axial direction of the drum is decreased when the number of segments is increased. Furthermore, the distance between two subsequent vertical circle halves should be slightly longer than the diameter of the largest coin appearing in the coin system in question in order to avoid the risk of such a coin getting stuck. Trials have shown, that a distance of 45 mm between two vertical circle halves combined with four segments according to FIG. 2, gives a very high probability of separation for the preferred embodiment of the invention, without the transport velocity. decreasing to an unacceptably low level.

Figure 3:
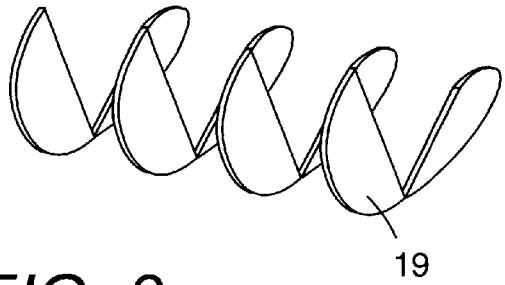

In FIG. 3 there is shown an alternative design 19 of the insert element. In essence, the only difference compared to the insert element 18 described above is that here, both of the circle or ellipse halves are angled to the same extent with respect to the radial direction of the drum. Such a design provides a smoother transport, since the mass of coins is now transported forward during the entire revolution of the drum. On the other hand, there is a loss to a certain extent of the tumbling effect which is periodically achieved according to the previous embodiment, and hence, the first embodiment 18 is currently regarded as the most suitable design to be used in the device according to the preferred embodiment, and this is true also from a manufacturing point of view.

Figure 4:
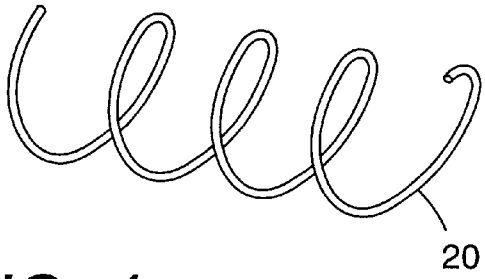

In FIG. 4 yet another embodiment 20 of the insert element is illustrated. Here, the insert element is helically formed from a wire- or strip-shaped element of for instance metal. However, the function is essentially the same as with the alternative 19 according to FIG 3.

The insert element 18 according to FIG. 2 as well as the insert element 19 according to FIG. 3 may be provided with fine perforations in order to avoid adhesion of wet 20 coins or foreign objects to the surfaces of the insert element due to capillary forces.

Preferably, the drum perforations 14 are formed as round holes, the diameter of which is chosen to be slightly smaller than the smallest coin size acceptable to the coin handling machine in question.

As a driving device 15 preferably any previously known simple electrical motor is used, which is capable of driving the drum through the driving belt 16 in rotation around its longitudinal axis. The driving device 15 is responsive to a control signal for setting the rotational speed of the drum.

The operation and the function of the device according to the preferred embodiment of the invention will now be described.

A mass of coins, which may be unsorted and may contain foreign objects, is deposited by a customer into a coin intake in a machine for sorting and/or counting the coins in said mass of coins The coin intake is connected to the intake 10, the mass of coins thereby being supplied to the drum 13 through the intake 10. Through the rotation of the drum 13 by means of the driving device 15 the mass of coins is transported in a way described below through the drum from the coin intake to the coin lifting device, which then forwards the coins to subsequent sorting and counting processes. Any foreign objects present in the mass of coins are separated during the transport in the drum through the drum perforations 14, and these objects are collected in the collecting vessel 17.

Foreign objects with an elongated shape, such as paper clips, hair pins, screws, etc, and with a length that exceeds the diameter of the perforations must be given a radial direction with respect to the cross section of the drum in order to be able to pass through the drum perforations, and hence the insert element 18 has been given its design as described above. In combination with the rotation of the drum the insert element exposes the transported mass of coins to a tumbling movement. Thus, the elongated foreign objects in the mass of coins are together with the rest of the objects given a constantly varying direction thanks to the tumbling during the transport through the drum. Sooner or later during this transport such an elongated foreign object will get a radial direction with respect to the cross section of the drum and will hence pass through the nearest perforation 14. "Valid" coins, which are accepted by the coin counting and sorting machine, can never be filtered out through the perforations, since the diameter of all such coins is larger than the diameter chosen for the perforations.

An important parameter when it comes to designing the device according to the invention is the length of the drum 13. More specifically, if the drum is too short, all foreign objects will not have the time to be separated during the transport through the drum. On the other hand, the drum may not be arbitrarily long, since the device should preferably fit inside a coin sorting and counting machine.

The diameter of the perforations is, as described above, also important, and so is the rotational speed of the drum.

A suitable perforation diameter is 13–16 mm for the preferred embodiment of the invention, but other values may also be appropriate.

Figure 5:
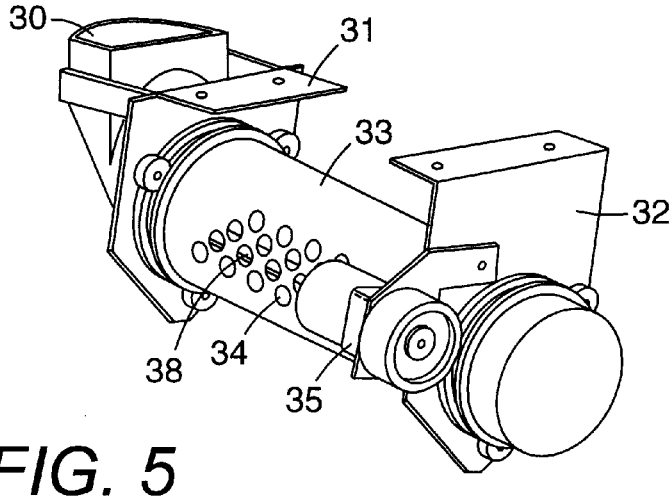
FIG. 5 is a perspective view of a device according to an alternative embodiment of the invention.

An alternative embodiment of the device according to the present invention will now be described with reference to FIG. 5–7.

In similarity to the above the device comprises a coin intake 30, suspension means 31, 32, a drum 33 with perforations 34 and a driving device 35. Even if this embodiment exhibits design differences as compared to the previously described preferred embodiment, the parts specified above according to FIGS. 5–7 all have essentially the same function as the corresponding parts according to FIGS. 1–4, and hence these parts are not described in more detail here.

One thing that differs, however, is that the drum 33 is now arranged in a downward slope towards the coin lifting device for reasons obvious from the following.

Figure 6:
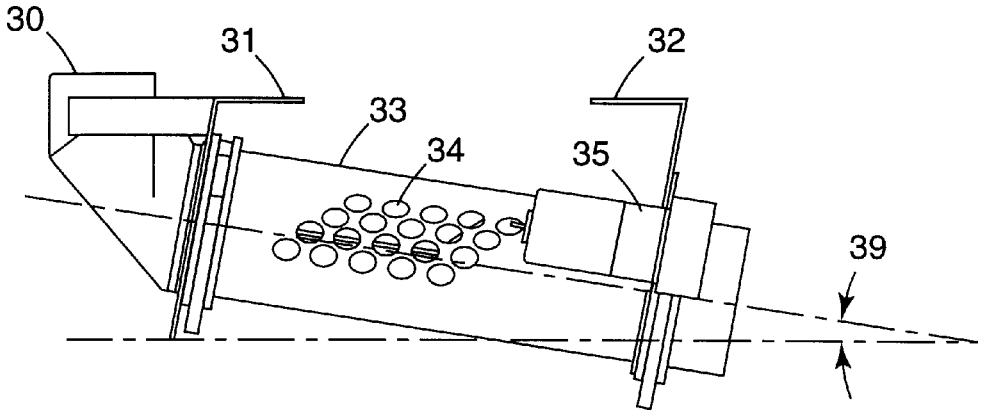
FIG. 6 is a side view of the device according to FIG. 5.
Figure 7:
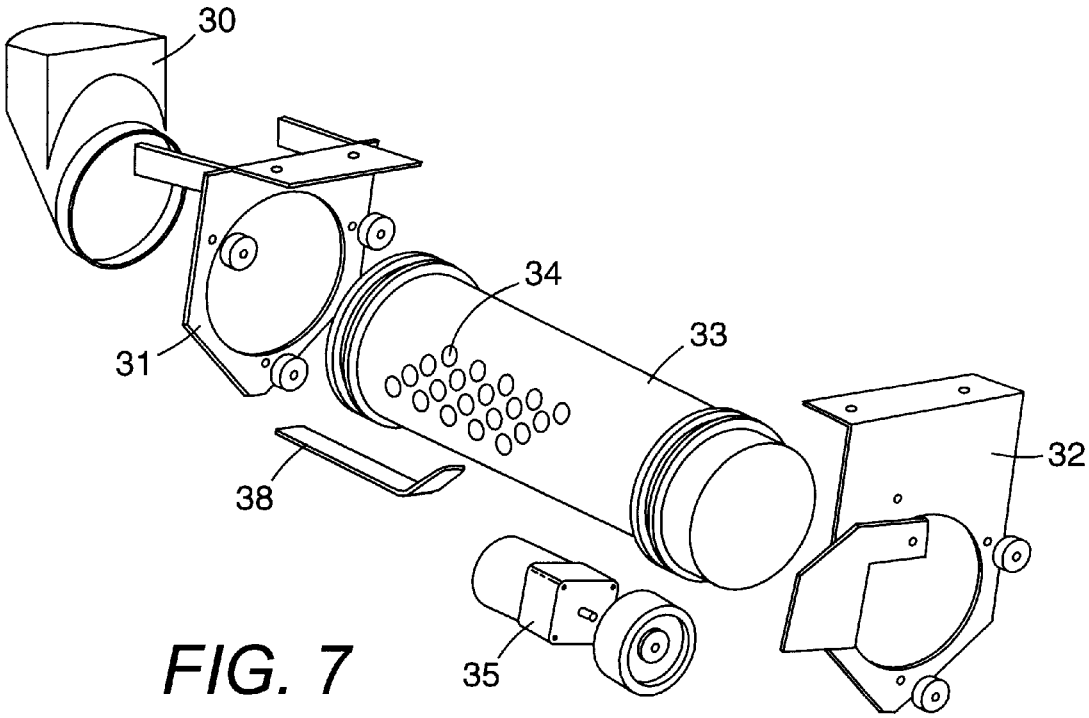
FIG. 7 is an exploded perspective view of the device according to FIGS. 5 and 6.

In FIG. 6. reference numeral 39 indicates the drum angle with respect to the horizontal plane.

A number of carrier rails 38 are mounted on the inner wall of the drum 33, essentially in the axial direction of the drum. These rails, which preferably are made of metal 35 or plastics, are preferably arranged with a certain displacement placement in relation to each other in the axial direction of the drum, and they are bent at an obtuse angle at the end pointing away from the coin intake. A suggested design of the carrier rails 38 is illustrated more clearly in FIG. 7.

Hence, the carrier rails 38 have replaced the insert element 18; 19; 20 described above, and an advantage with this approach is that the rails may be manufactured at a very low cost. The purpose of the rails is to expose the mass of coins to a tumbling force when the drum 33 is rotated and to contribute to the transport of the mass of coins through the drum. Thanks to the downward slope of the drum according to the above the transport of the mass of coins is facilitated. In order to prevent elongated foreign objects in particular to pass through the entire drum 33 without being separeted, the rails 38 are as described above bent at the far end pointing towards the coin lifting device, thereby aiming at giving such foreign objects a direction suitable for separation through any of the perforations 34.

As an alternative to this embodiment the inner wall of the drum is additionally provided with a number of members, not shown in the figures, which are formed as pins or edges protruding in an essentially radial direction. These members also help in giving elongated foreign objects an orientation which is mainly orthogonal to the axial direction of the drum, thereby facilitating separation through the perforations.

An important parameter of the embodiment is the drum inclination or angle 39 with respect to the horizontal plane. If the inclination is too steep, the mass of coins will be transported too quickly through the drum, thereby not letting all foreign objects to be separated. If the inclination is too small, difficulties arise when it comes to transporting the mass of coins. In practice, an angle of inclination of about 10–15 degrees has proved suitable.

The driving device 15; 35 according to either of the embodiments described above is responsive to an external control signal for setting the rotational speed of the drum. Preferably, this external control signal it generated by a sensor in the coin lifting device, the control signal thereby having a nominal value, when the flow of coins into the coin lifting device—or, alternatively, the coin level in the device—lies within the limits of a successful handling of the coins for the coin lifting device and subsequent sorting and counting processes. In response to this nominal value of the control signal the driving means will drive the drum at a predetermined rotational speed according to the above, thereby obtaining a certain speed of coin flow. When the flow of coins reaches such a previously determined level, where the coin lifting device or any subsequent sorting and counting process is no longer able to handle all incoming coins successfully, but is rather risking to reach an overfilled condition, the control signal is given another value, wherein the driving device will detect the changed control signal and lower the rotational speed of the drum. As a consequence the coin flow speed will decrease, and the coin lifting device will be able to handle the superfluity of coins at the coin lifting device. When the level of coins in the coin lifting device returns below a predetermined level, the control signal is given its nominal value, the drum thereby returning to its normal rotational speed.

As an alternative, a sensor may be provided for measuring the drum speed. This sensor is operatively connected to a control unit capable of monitoring the momentary speed as detected by the sensor, thereby detecting an over-full or packed drum condition, since the speed will then have decreased below a predetermined value. When this is the case, a control signal is supplied to the driving device 15; 35 for adjusting the rotational speed in a way similar to the one described above.

Hence, in this aspect, the device according to the invention has a function as a protection against overfilling or a buffer receptacle. Within the scope of the invention the reduction described above of the rotational speed may be carried out in several steps, wherein the control signal may be given a corresponding number of different values. Furthermore, the rotational speed may be reduced to a zero value, wherein the drum does not move, or to a negative value, wherein the drum is rotating in an opposite direction as compared to the normal direction. This is especially suitable to remedy such situations, wherein elongated objects are in some way stuck in the drum, thereby obstructing the flow of coins.

According to yet another alternative embodiment of the invention, the drum is manufactured with an essentially polygonal cross section, such as a square shape or a hexagonal shape. Thanks to the angularity of this cross section a mass of coins being transported through the rotating drum will be exposed to a tumbling force similar to the one described above for the embodiment according to FIGS. 5–7. With a polygonal cross section of the drum the need for separately mounted carrier rails 38 is consequently eliminated or reduced. The rest of the device according to this embodiment is essentially designed in accordance with the embodiments described above.

What is claimed is:

1. A coin handling machine, comprising:

a coin intake adapted to receive a mass of objects including a plurality of desired coins having a minimum coin diameter;

a coin processing device for counting or sorting said plurality of desired coins;

a drum for separating foreign objects other than said plurality of desired coins from said mass of objects prior to conveyance to said coin processing device, the drum having a first open end for receiving said mass of objects from the coin intake and a second open end, opposite said first end, for allowing said plurality of desired coins to exit said drum, the drum further having a plurality of perforations, each of which has a diameter smaller than said minimum coin diameter, for allowing exit of said foreign objects through said perforations but not of any of said plurality of desired coins;

a driving device for rotating said drum; and an agitating member mounted internally in said drum and having at least a first portion adapted to urge said mass of objects in an essentially longitudinal direction of said drum towards said second open end, and said agitating member having at least a second portion adapted to urge said mass of objects in a direction essentially transversal to said longitudinal direction of said drum.

2. A coin handling machine as in claim 1, wherein the agitating member comprises at least one elongated carrier rail formed on an inner surface of the drum, said rail having a first portion, which is parallel to said longitudinal direction of the drum, and a second portion, which is non-parallel to said longitudinal direction of the drum.

3. A coin handling machine as in claim 2, wherein said carrier rail is bent at an obtuse angle at an end pointing away from the coin intake.

4. A coin handling machine as in claim 2, wherein the agitating member comprises a plurality of carrier rails, which are displaced with respect to each other in said longitudinal direction of the drum.

5. A coin handling machine as in claim 1, wherein the drum has a substantially circular cross section.

6. A coin handling machine as in claim 1, wherein the drum has a substantially polygonal cross section.

7. A coin handling machine as in claim 1, wherein the drum is arranged in a downward slope towards the coin processing device.

8. A coin handling machine as in claim 1, wherein a number of essentially radially protruding pins or edges are formed on an inner surface of the drum.

9. A coin handling machine as in claim 1, wherein said first portion of the agitating member comprises at least a first essentially semicircular or semielliptical flat member, and wherein said second portion of the agitating member comprises at least a second essentially semicircular or semielliptical flat member, the first and second members being connected to each other at an angle.

* * * * *